US005377605A

United States Patent [19]

Frye

[11] Patent Number: 5,377,605

[45] Date of Patent: Jan. 3, 1995

[54] DUAL CLAMPING SYSTEM

[75] Inventor: Rick J. Frye, Miamisburg, Ohio

[73] Assignee: MIM Industries, Inc., Miamisburg, Ohio

[21] Appl. No.: 913,135

[22] Filed: Jul. 14, 1992

[51] Int. Cl.[6] ..... D05B 21/00

[52] U.S. Cl. ..... 112/114; 112/121.15; 112/121.12

[58] Field of Search ..... 112/114, 121.12, 121.15, 112/103, 262.3, 265.1

[56] References Cited

U.S. PATENT DOCUMENTS

| | | | |
|---|---|---|---|
| 223,626 | 12/1840 | Ladue | 112/2 |
| 2,768,592 | 10/1956 | Bihaly | 112/2 |
| 3,664,283 | 5/1972 | McFalls | 112/121 |
| 4,305,338 | 12/1981 | Adamson | 112/113 |
| 4,411,208 | 10/1983 | Nishida et al. | 112/103 |
| 4,485,574 | 12/1984 | Bennetot | 38/102 |
| 4,493,276 | 1/1985 | Sadeh | 112/121 |
| 4,494,470 | 1/1985 | Fischer et al. | 112/121.12 |
| 4,503,789 | 3/1985 | Scholl | 112/121 |
| 4,534,303 | 8/1985 | Off et al. | 112/114 |
| 4,682,551 | 7/1987 | Toman | 112/103 |
| 4,694,766 | 9/1987 | Wickers et al. | 112/262 |
| 4,763,587 | 8/1988 | Frye | 112/121 |
| 4,854,251 | 8/1989 | Hiramatsu et al. | 112/121 |
| 4,870,917 | 10/1989 | Frye | 112/121 |
| 4,903,620 | 2/1990 | Bisson et al. | 112/121.12 |
| 5,000,103 | 3/1991 | Beermann | 112/121.15 X |
| 5,074,230 | 12/1991 | Morii et al. | 112/114 |
| 5,094,179 | 3/1992 | Badillo | 112/114 |
| 5,101,746 | 4/1992 | Frye | 112/121 |
| 5,114,056 | 5/1992 | Frye | 223/30 |
| 5,146,859 | 9/1992 | Conley, Jr. et al. | 112/114 |

FOREIGN PATENT DOCUMENTS

| | | |
|---|---|---|
| 991161 | 5/1965 | United Kingdom . |
| 2167456 | 5/1986 | United Kingdom . |
| 2143550 | 2/1989 | United Kingdom . |

OTHER PUBLICATIONS

"The Technologies of MIM Industries, Inc." published approx. Jan. 1, 1990.

*Primary Examiner*—Clifford D. Crowder
*Assistant Examiner*—Paul C. Lewis
*Attorney, Agent, or Firm*—Biebel & French

[57] ABSTRACT

This invention relates to a dual clamping system for a sewing machine. The dual clamp system comprises a first clamp and a second clamp which may be used to clamp a first workpiece and a second workpiece, respectively, at a sewing station of the sewing machine. The first and second clamps are preferably of different shapes and dimensions so that different shaped workpieces can be clamped at the sewing station. In the preferred embodiment, the first and second clamps are adjustable inner clamps for clamping an inner portion of the first and second workpieces, respectively. The dual clamping system also comprises a peripheral clamp for clamping at least a portion of the periphery of either or both of the first and second workpieces at the sewing station. The dual clamping system permits an operator to either separately or simultaneously clamp and sew a plurality of workpieces having the same or different shapes.

23 Claims, 3 Drawing Sheets

DUAL CLAMPING SYSTEM

BACKGROUND OF THE INVENTION

1. Field of the Invention

This invention relates to a sewing machine, and more particularly, it relates to a dual clamping system having a first clamp and a second clamp which are capable of either separately or simultaneously clamping a first workpiece and a second workpiece, respectively, against a sewing surface in the sewing machine.

2. Description of the Related Art

In the sewing industry, the use of a clamp to clamp or hold workpieces at a sewing station is quite common. It is also common to use a clamp to clamp a label, patch or emblem onto a workpiece, such as a shirt or jacket, so that the label patch or emblem can be sewn thereon. One problem with the sewing machines of the past was that they were only equipped to clamp one workpiece at a time. When manufacturing workpieces having two or more labels sewn thereon, it was often necessary to separately clamp and sew each label onto the workpiece. This usually required a separate clamping and sewing operation for each label.

Another problem was that the operator had to stop sewing the workpiece and change clamps whenever two or more labels of different sizes were to be sewn on the workpiece. For example, if two labels were to be sewn on the workpiece, the operator would clamp and sew the first label with a first clamp. The operator would then change the clamp in the sewing machine and replace it with another clamp that was suitable for clamping the second label. The operator would then clamp and sew the second label. This procedure would be repeated for each different label. The sewing machine usually had to be shut down whenever the operator had to change clamps. This down time resulted in lost production and labor time.

As an alternative approach, an operator would sew a first label on all of the workpieces with a first clamp, and then the operator would change clamps and sew a second label on all of the workpiece with a second clamp. This required that the operator position the workpiece at the sewing station at least two times, thereby resulting in a duplication and repetition of production and labor time.

SUMMARY OF THE INVENTION

There is, therefore, a present need to provide a dual clamping system for clamping a first workpiece and a second workpiece against a sewing surface in a sewing machine, without having to change clamps in the sewing machine.

In one aspect, this invention comprises a clamping system for clamping a plurality of workpieces against a sewing surface in a sewing machine, said clamping system comprising a clamp for securing said plurality of workpieces against said sewing surface; and a driver for coupling said clamp to the sewing machine; said driver being capable of driving said clamp into engagement with said plurality of workpieces to secure said plurality of workpieces against said sewing surface.

An object of this invention is to provide a dual clamping system which can clamp two or more workpieces at a sewing station in a sewing machine.

Another object of this invention is to provide a dual clamping system which is capable of clamping two or more workpieces having different shapes at a sewing station in the sewing machine, without the need for changing clamps.

Yet another object of this invention is to provide a dual clamping system which is capable of sewing labels having different shapes.

Still another object of this invention is to provide a dual clamping system which is capable of clamping an inner portion of the workpiece.

These objects, and others, may be more readily understood in connection with the following specification, claims, and drawing.

DESCRIPTION OF THE PREFERRED EMBODIMENT

Figure 1:
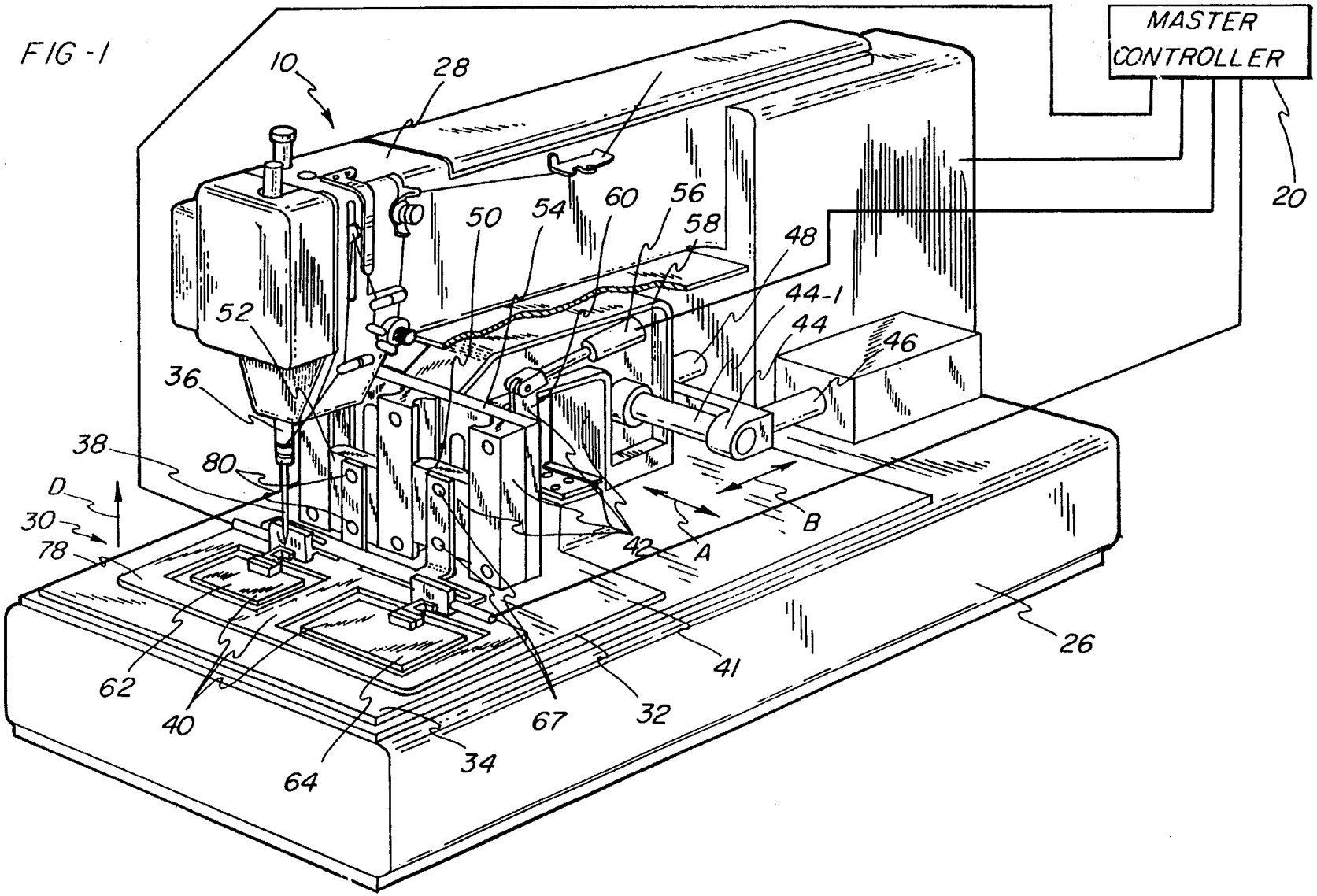
FIG. 1 is a perspective view of a sewing machine in which an embodiment of this invention may be used.

FIG. 1 shows a perspective view of a sewing machine, hereinafter designated a sewing machine 10 in which a preferred embodiment of this invention may be used. The function of the sewing machine 10 is to sew a first workpiece 12 (FIG. 2) and a second workpiece 14 onto a receiving workpiece 16. In the embodiment being described, the workpiece 12 is sewn onto the receiving workpiece 16 with a first predetermined stitch pattern 18 in accordance with a computer program (not shown) which is controlled by a master controller 20 in the sewing machine 10. Likewise, the second workpiece 14 is sewn onto the receiving workpiece 16 with a second predetermined stitch pattern 21. The sewing machine 10 may be a programmable sewing machine, such as the Brother BAS Model 340 which is manufactured by Brother Industries of Japan. The sewing machine 10 comprises a base 26 (FIG. 1) having a horizontal arm 28 secured thereto. The sewing machine 10 also comprises a sewing station 30 at which the first and second workpieces 12 and 14 can be clamped against a cloth plate 32 which provides a clamping or sewing surface 34.

As best illustrated in FIG. 1, the horizontal arm 28 extends out over the sewing surface 34, and it has a needle holder 36 which supports a needle 38 for reciprocating motion in a fixed path that is generally vertical and perpendicular to the sewing surface 34. The needle 38 moves down through a hole (not shown) in a throat plate (not shown) at the bottom of its stroke to transfer a loop of thread (not shown) to a loop taker (not shown) under the sewing surface 34 at the sewing station 30. The loop taker (not shown) and needle holder 36 are both connected to a motor (not shown) which is controlled by the master controller 20 in the sewing machine 10.

The sewing machine 10 further includes a dual clamp system 40 which is coupled to a driver assembly or drive means 42. A function of drive means 42 is to move the dual clamp system 40 and cloth plate 32 over the sewing surface 34 in accordance with the computer programs (not shown) in order to sew the first and second workpieces 12 and 14 onto the receiving workpiece 16 with the first and second predetermined stitch patterns 18 and 21, respectively. The drive means 42 comprises a yoke 44 having a yoke shaft 44-1 which permits the dual clamp system 40 to move in an X direction indicated by double arrow A in FIG. 1. The yoke 44 is coupled to a pair of shafts 46 and 48 which can cause the yoke 44 and dual clamp system 40 to move in a Y direction, indicated by double arrow B. The shafts 46 and 48 are coupled to a stepper motor (not shown) by various belts, gears and pulleys (not shown) in the sewing machine 10. The master controller 20 can energize the stepper motors, individually or simultaneously, to move the dual clamp system 40 in accordance with the computer program (not shown) so that the first and second workpieces 12 and 14 can be sewn onto the receiving workpiece 16 with the first and second predetermined stitch patterns 18 and 21, respectively.

The drive means 42 of sewing machine 10 also comprises mounting means for detachably and adjustably mounting the dual clamp system 40 to sewing machine 10. In the embodiment being described, mounting means comprises a pair of brackets 50 and 52 which are slidably mounted in a bracket support 54, as best illustrated in FIG. 1. The bracket 50 is coupled to a solenoid 56 which is conventionally mounted on the arch member 58 via an armature 60. Likewise, the bracket 52 is mounted to a similar solenoid (not shown) which is mounted on the opposite side (as viewed in FIG. 1) of the arch member 58. The master controller 20 can energize the solenoids to cause the brackets 50 and 52 to move up and down in the bracket support 54 and towards and away from the sewing surface 34. Although mounting means has been shown and described as including, for example, the arch member 58, solenoid 56 and sliding brackets 50 and 52, it could comprise any suitable means for detachably and adjustably mounting the dual clamp system 40 to the sewing machine 10. Likewise, the drive means could comprise any suitable means for moving the dual clamp system 40 at the sewing station 30.

Figure 2:
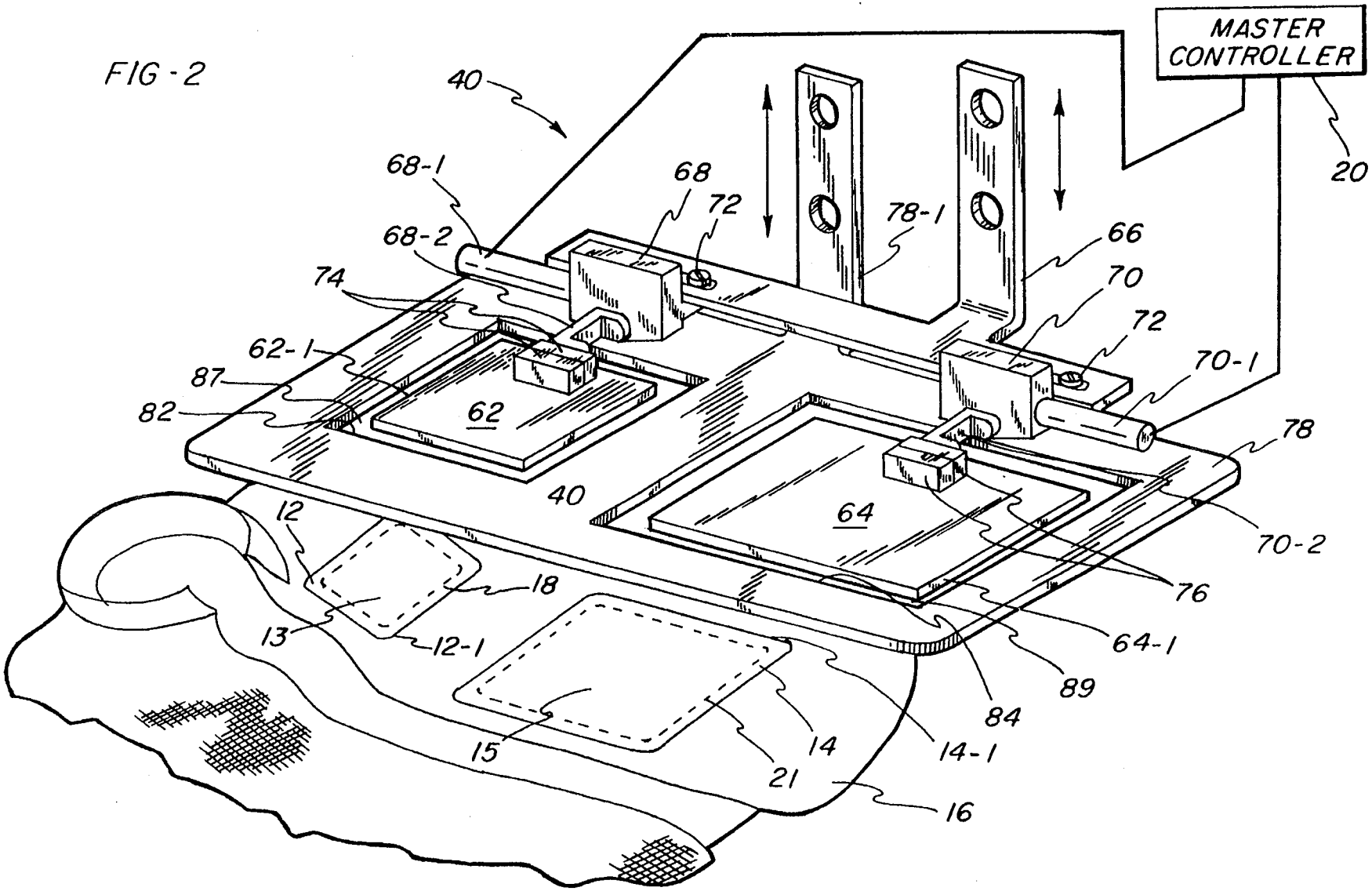
FIG. 2 is a perspective assembled view of a dual clamping system shown in FIG. 1.

As best illustrated in FIG. 2, the dual clamp system 40 comprises a first clamp 62 for clamping an inner portion 13 of the first workpiece 12 and a second clamp 64 for clamping an inner portion 15 of the second workpiece 14. The dual clamp system 40 also comprises coupling means or a first L-shaped bracket 66 which is secured to bracket 50 by suitable means such as screws 67 (FIG. 1). As best shown in FIG. 2, coupling means also comprises a first 360° coupling 68-2 and a second 360° coupling 70-2 slidably secured thereto by suitable means, such as flat head screws 72. The first and second 360° couplings 68 and 70 couple the first and second clamps 62 and 64, respectively, to the first L-shaped bracket 66, as shown in FIG. 2. The first 360° coupling 68 has a solenoid 68-1 and the second 360° coupling has a solenoid 70-1. The solenoids 68-1 and 70-1 are coupled to the master controller 20, as illustrated in FIG. 2, which can selectively energize the solenoids 68-1 and 70-1 and thereby cause cranks 68-2 and 70-2 to flip-flop so that the sewing machine 10 can sew stitch patterns which are endless or continuous.

The coupling means further comprises a first quick release mechanism 74 and a second quick release mechanism 76 which enable the first and second clamp 62 and 64, respectively, to be quickly and easily dismounted from the L-shaped bracket 66. The first and second quick release mechanisms 74 and 76 are similar to the release mechanisms shown and described in U.S. Pat. No. 4,763,587, issued on Aug. 16, 1988; U.S. Pat. No. 4,870,917, issued on Oct. 3, 1989; and U.S. Pat. No. 5,101,746, issued on Apr. 7, 1992, which are assigned to the same assignee as the present invention and which are hereby incorporated by reference and made a part hereof. Although not shown, the coupling means could include any suitable structure or arrangement for coupling the first and second clamps 62 and 64 to the L-shaped bracket 66.

Figure 3:
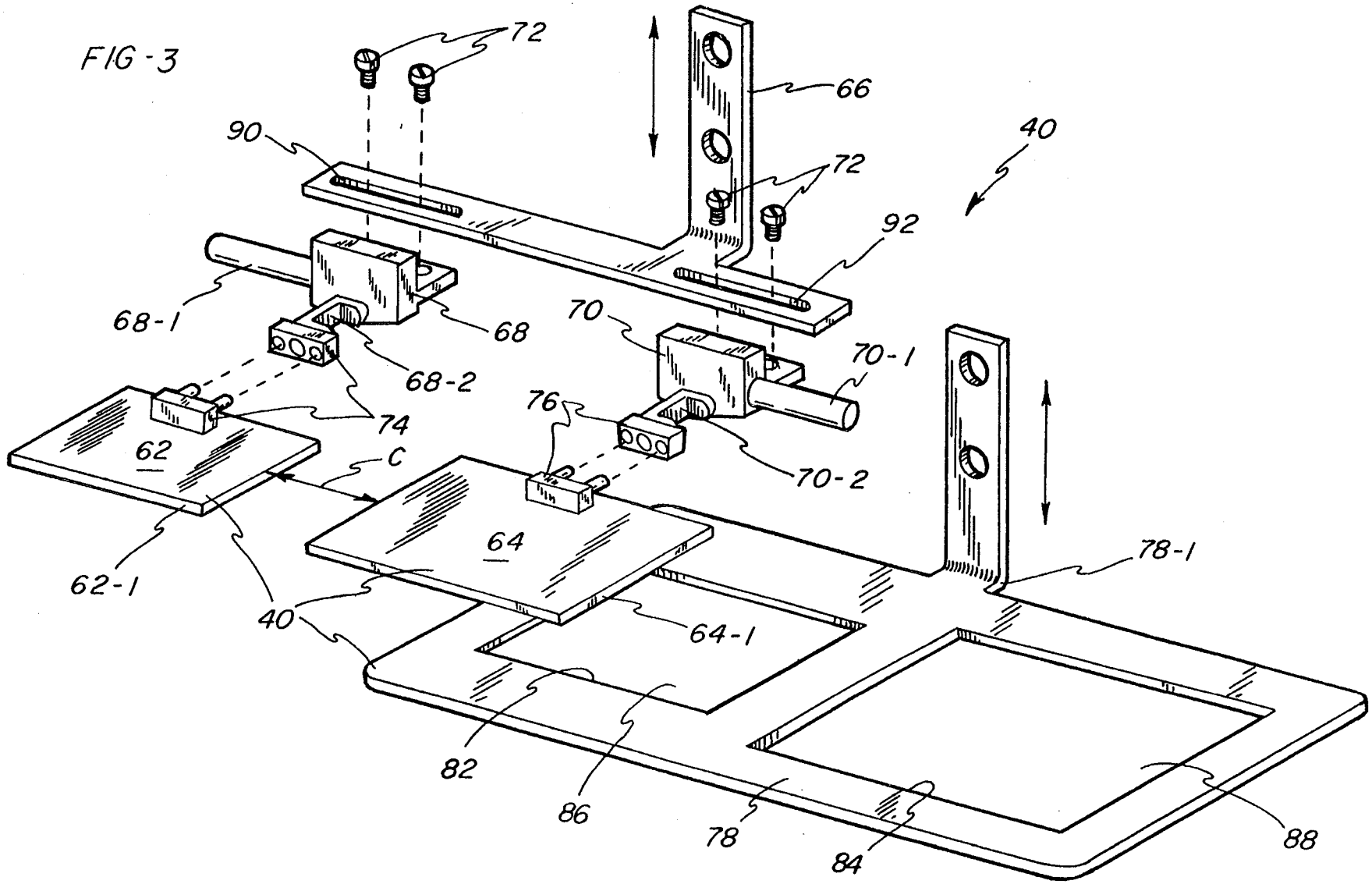
FIG. 3 is a perspective exploded view of the dual clamping system shown in FIG. 2.

As best shown in FIG. 3, the L-shaped bracket 66 comprises a pair of elongated slots 90 and 92 which permit the first and second quick release mechanisms 74 and 76 and clamps 62 and 64 to be moved or adjusted towards and away from each other. This permits the distance (indicated by double arrow C in FIG. 3) to be adjusted in order to accommodate a variety of different spacing arrangements between the first and second workpieces 12 and 14.

It is to be noted that the first clamp 62 has a peripheral or exterior edge 62-1 (FIG. 2) which defines a first predefined clamping area which generally corresponds to the inner portion 13 of the first workpiece 12. Likewise, the second clamp 64 has a peripheral or exterior edge 64-1 which defines a second predefined clamping area which generally corresponds to an inner portion 15 of the second workpiece 14. Although the first and second predefined clamping areas defined by the first and second clamps 62 and 64 are shown as being unequal or dissimilar, the first and second clamps 62 and 64 could have first and second predefined clamping means which are the same.

The dual clamp system 40 also comprises a peripheral clamp 78 which is coupled to the bracket 52 (FIG. 1) of drive means 42. The peripheral clamp 78 comprises an L-shaped bracket portion 78-1 for coupling the peripheral clamp 78 to the bracket 52 (FIG. 1) using the flat head screws 80. The peripheral clamp 78 is capable of simultaneously clamping at least a portion of a peripheral clamping area of the first and second workpieces 12 and 14. The peripheral clamping area of the first workpiece 12 is generally defined as the area between the first predetermined stitch 18 and peripheral edge 12-1. Likewise, the peripheral clamp area of the second workpiece 14 is generally defined as the area between peripheral edge 14-1 and the second predetermined stitch pattern 21. The peripheral clamp 78 comprises a first inner edge 82 and a second inner edge 84 which define a first aperture 86 and a second aperture 88 for receiving the first and second clamps 62 and 64, respectively. As best illustrated in FIG. 2, the inner edges 82 and 84 cooperate with the exterior edges 62-1 and 64-1, respectively, to define sewing areas 87 and 89 in which the sewing machine 10 may sew the first and second predetermined stitch patterns 18 and 21. Although the first and second clamps 62 and 64 and first and second apertures 86 and 88 have been shown as being generally rectangular in shape, they could be any desired shape. In the embodiment being described and shown, they have a shape which corresponds to the shape of the first and second workpieces 12 and 14.

It is to be noted that although the sewing machine is shown using the peripheral clamp 78, it should be appreciated that the clamping system 40 could be used without the peripheral clamp 78. Alternatively, the peripheral clamp 78 could be used alone, without the first and second inner clamps 62 and 64.

The peripheral clamp 78 is capable of simultaneously clamping a portion of the peripheral edge 12-1 (FIG. 2) of the first workpiece 12 and also a portion of the peripheral edge 14-1 of the second workpiece 14 against the sewing surface 34 of cloth plate 32.

It is to be noted that the master controller 20 is capable of selectively energizing the first solenoid 56 and second solenoid (not shown) in order to cause the inner clamps 62 and 64 and peripheral clamp 78 to move towards and away from the sewing surface 34.

The operation and method for sewing a plurality of workpieces at the sewing station 30 will now be described. An operator selects first and second clamps 62 and 64 having first and second predefined clamping areas, respectively, which generally correspond to the inner portions 13 and 15 of the first and second workpieces 12 and 14. The operator then mounts the first and second clamps 62 and 64 to the L-shaped bracket 66 using the quick release mechanisms 74 and 76, respectively. The operator may cause the master controller 20 to energize the solenoid 56 to move the bracket 50 in the direction of arrow D in FIG. 1 so that the first and second clamps 62 and 64 are in a nonclamping, raised position above the sewing surface 34.

In the embodiment being described, a suitable peripheral clamp 78 is selected and mounted to the bracket 52. The operator then causes the master controller 20 to energize the second solenoid (not shown) to cause the bracket 52 to move in the direction of arrow D so that the peripheral clamp 78 is also in a nonclamping position. The workpiece 16 (FIG. 2) is positioned at the sewing station 30 on the sewing surface 34 underneath the peripheral clamp and dual clamp. The first workpiece 12 is positioned on workpiece 16 in association with and underneath the first clamp 62, and the second workpiece 14 is positioned on workpiece 16 in association with and underneath the second clamp 64. The operator then causes the master controller 20 to energize the second solenoid (not shown) to move the bracket 52 of drive means 42 towards the sewing surface 34 so that the peripheral clamp 78 clamps a portion of the peripheral clamping area against the receiving workpiece 16. Master controller 20 then energizes the first solenoid 56 to move the bracket 50 towards the sewing surface 34 so that the first and second clamps 62 and 64 clamp the inner portions of the first and second workpieces 12 and 14, respectively, against the workpiece 16. The master controller 20 then energizes the drive means 42 to cause the dual clamp system 40 to move in the X and Y directions in accordance with the computer program (not shown) so that the first and second predetermined stitch patterns 18 and 21 can be sewn on the first and second workpieces 12 and 14, respectively.

Having sewn the first and second workpieces 12 and 14 on workpiece 16, the operator may then cause the master controller 20 to energize the first solenoid 56 and second solenoid (not shown) to cause the first and second clamps 62 and 64 and peripheral clamp 78 to unclamp the first and second workpieces 12 and 14. The workpiece 16 may then be removed from the sewing station 30 and a new workpiece 16 inserted in its place and the process repeated so that first and second workpieces 12 and 14 can be sewn onto another new workpiece 16.

It should be appreciated that, if desired, the operator could clamp and sew the first and second workpieces 12 and 14 on the workpiece 16 individually or one at a time.

Another method of sewing the first and second workpieces 12 and 14 will now be described. After the operator has inserted the receiving workpiece 16 in the sewing station 30, the first workpiece 12 may be placed on the receiving workpiece 16 under the first clamp 62. The operator may then cause master controller 20 to cause the peripheral clamp 78 and first clamp 62 to clamp the first workpiece 12 against the workpiece 16 so that the workpiece 12 may be sewn thereon. Master controller 20 then causes the sewing machine 10 to sew the first workpiece 12 onto the workpiece 16 with the first predetermined stitch pattern 18. The operator would then cause the master controller 20 to unclamp the first workpiece 12 and receiving workpiece 16. The operator could then adjust and position the receiving workpiece 16 so that the second workpiece 14 may be placed at a predetermined location on the receiving workpiece 16 where it is desired to have the second workpiece 14 located thereon. The master controller 20 then causes the peripheral clamp 78 and second clamp 64 to clamp the second workpiece 14 against the receiving workpiece 16. The master controller 20 would then cause the sewing machine 10 to sew the second workpiece 14 onto the receiving workpiece 16 with the second predetermined stitch pattern 21. After the second workpiece 14 is sewn on the receiving workpiece 16, the receiving workpiece 16 may be removed from the sewing station 30.

Advantageously, the embodiment being described permits a sewing machine 10 to simultaneously clamp and sew a plurality of workpieces at a sewing station 30. Also, this invention enables an operator to clamp workpieces having different shapes at the sewing station 30 without having to change any clamps in the sewing machine 10. The first and second workpieces 12 and 14 may be clamped and sewn in one sewing operation, or alternatively, they may be sewn separately onto the receiving workpiece 16 in the manner described above. This permits an operator to sew a plurality of workpieces onto the receiving workpiece 16 during one sewing operation, without the need for changing clamps.

Various changes or modifications in the invention described may occur to those skilled in the art without departing from the true spirit or scope of the invention. For example, although the first and second clamps 62 and 64 have been shown and described as being clamps which clamp the inner portions of the first and second workpieces 12 and 14, respectively, they could be a peripheral or template clamps (not shown) which have openings which define an area in which the sewing needle 38 can sew a stitch pattern. This may be particularly useful where the workpiece 16 to be sewn is small. In addition, although the embodiment being described herein is shown with the peripheral clamp 78, there may be sewing operations in which the peripheral clamp 78 is not used, such as when the periphery of the workpiece has to be sewn. Also, the peripheral clamp 78 could be configured to clamp the peripheral clamping area of only one of the first or second workpieces 12 and 14. Likewise, the sewing system of the present invention may be used with only the peripheral clamp 78 and without the first and second clamps 62 and 64. This may be particularly useful when sewing the inner area of the first and second workpieces 12 and 14.

The above description of the invention is intended to be illustrative only and not limiting and it is not intended that the invention be restricted thereto but that it be limited only by the true spirit and scope of the appended claims.

What is claimed is:

1. A clamping system for clamping a plurality of workpieces against a sewing surface in a sewing machine, said clamping system comprising:

a clamp for securing said plurality of workpieces independently of each other against said sewing surface; and a driver coupled to said clamp for coupling said clamp to the sewing machine and also for driving said clamp into engagement with said plurality of workpieces to secure said plurality of workpieces against said sewing surface when said driver is energized; and each of said plurality of workpieces comprising an inner clamp portion, said clamp comprising a plurality of inner clamps for clamping said inner clamp portion of each of said plurality of workpieces against said sewing surface.

2. The clamping system as recited in claim 1 wherein each of said plurality of workpieces comprises a peripheral clamping area, said clamping system further comprising a peripheral clamp coupled to said driver for clamping said peripheral clamping area of each of said plurality of workpieces against the sewing surface.

3. The clamping system as recited in claim 1 wherein each of said plurality of workpieces comprises a peripheral clamping area, said clamping system further comprising a peripheral clamp for clamping the peripheral clamping area of each of said plurality of workpieces;

said peripheral clamp and said inner clamps cooperating to simultaneously clamp said peripheral clamping area and said inner clamping portion respectively, of each of said plurality of workpieces.

4. The clamping system as recited in claim 3 wherein said peripheral clamp comprises a plurality of interior edges defining a plurality of apertures, each of said apertures receiving at least one of said plurality of inner clamps.

5. The clamping system as recited in claim 1 wherein said sewing surface comprises a cloth plate.

6. A clamping system for clamping a plurality of workpieces against a sewing surface in a sewing machine, said clamping system comprising:

a clamp for securing said plurality of workpieces against said sewing surface; and a driver for coupling said clamp to the sewing machine;

said clamp being driven into engagement with said plurality of workpieces to secure said plurality of workpieces against said sewing surface when said driver is energized;

each of said plurality of workpieces comprising an inner clamp area, said clamp comprises a plurality of inner clamps for clamping said inner portion of each of said plurality of workpieces against said sewing surface;

each of said plurality of workpieces further comprising a peripheral clamping area, said clamping system further comprising a peripheral clamp for clamping the peripheral clamping area of each of said plurality of workpieces;

said peripheral clamp and said inner clamps cooperating to simultaneously clamp said peripheral clamping area and said inner clamping portion, respectively, of each of said plurality of workpieces;

said peripheral clamp comprising a plurality of interior edges defining a plurality of apertures, each of said apertures receiving at least one of said plurality of inner clamps;

a master controller and an arch assembly; said driver comprising:

a first solenoid and a second solenoid which are mounted on said arch assembly and which are operatively coupled to said master controller;

said first solenoid having an armature coupled to a first sliding bracket member;

said second solenoid having an armature coupled to a second sliding bracket member;

an L-shaped bracket coupled to said first sliding bracket; and a plurality of quick release mechanisms for releasably coupling each of said plurality of inner clamps to said L-shaped bracket member;

said peripheral clamp being coupled to said second sliding bracket member;

said first and second solenoids causing said plurality of inner clamps and said peripheral clamp to move towards and away from the sewing surface when said first and second solenoids are energized by said master controller.

7. A dual clamp system for clamping a first workpiece and a second workpiece against a sewing surface in a sewing machine in combination with a sewing machine comprising:

a first clamp;

a second clamp;

drive means coupled to said first and second clamps for adjustably coupling said first and second clamps to said sewing machine and also for driving said first and second clamps into engagement with the first and second workpieces to independently clamp the first and second workpieces against the sewing surface;

said first clamp having a first predefined clamping area which generally corresponds to an inner portion of the first workpiece and the second clamp having a second predefined clamping area which generally corresponds to an inner portion of the second workpiece;

said first and second clamps being capable of independently clamping said inner portions of said first and second workpieces, respectively, so that a 360° stitch pattern may be sewn around said inner portions;

a bracket coupled to said drive means; and a first quick release mechanism and a second quick release mechanism for coupling the first and second clamps, respectively, to said bracket.

8. The dual clamp system as recited in claim 7 wherein the sewing machine comprises a master controller for controlling the operation of the sewing machine; said drive means comprising:

at least one solenoid coupled to said master controller, said solenoid having an armature coupled to said bracket, said master controller being capable of energizing said at least one solenoid to drive the bracket towards and away from said sewing surface thereby driving said first and second clamps towards and away from said sewing surface.

9. The dual clamp system as recited in claim 7 wherein said first and second quick release mechanisms each comprise a 360° coupling for permitting the sewing machine to sew an endless stitch pattern on said first and second workpieces.

10. The dual clamp system as recited in claim 9 wherein said bracket is generally L-shaped.

11. A dual clamp system for clamping a first workpiece and a second workpiece against a sewing surface in a sewing machine; said dual clamp system comprising:

a first clamp;

a second clamp; and drive means coupled to said first and second clamps for adjustably coupling said first and second clamps to said sewing machine and also for driving said first and second clamps into engagement with the first and second workpieces to independently clamp the first and second workpieces against the sewing surface;

said first clamp having a first predefined clamping area which generally corresponds to an inner portion of the first workpiece and the second clamp having a second predefined clamping area which generally corresponds to an inner portion of the second workpiece;

said first and second clamps being capable of independently clamping said inner portions of said first and second workpieces, respectively, so that a 360° stitch pattern may be sewn around said inner portions;

said first and second workpieces each having a peripheral clamping area; and a peripheral clamp coupled to said drive means, said peripheral clamp being capable of simultaneously clamping at least a portion of said peripheral clamping area of said first and second workpieces;

said first clamp and said second clamp each having a first outer edge and a second outer edge, respectively; said peripheral clamp comprising a first inner edge defining a first aperture and a second inner edge defining a second aperture; said first and second clamps being received in said first and second apertures, respectively, said first inner edge and said first outer edge cooperating to define a first sewing area, said second inner edge and said second outer edge cooperating to define a second sewing area.

12. A dual clamp system for clamping a first workpiece and a second workpiece against a sewing surface in a sewing machine; said dual clamp system comprising:

a first clamp;

a second clamp; and drive means coupled to said first and second clamps for adjustably coupling said first and second clamps to said sewing machine and also for driving said first and second clamps into engagement with the first and second workpieces to clamp the first and second workpieces against the sewing surface;

a bracket coupled to said drive means; and a first quick release mechanism and a second quick release mechanism for coupling the first and second clamps, respectively, to said bracket;

said first and second quick release mechanisms each comprising a 360° coupling for permitting the sewing machine to sew an endless stitch pattern on said first and second workpieces;

said bracket comprising adjusting means for permitting the first and second clamps to be moved towards and away from each other.

13. The dual clamp system as recited in claim 12 wherein said adjusting means comprises a plurality of slots located in said bracket and a plurality of fasteners operatively associated with said plurality of slots and said first and second quick release mechanisms for permitting the quick release mechanisms to be adjustably fastened to said bracket so that said first and second clamps may be moved towards and away from each other.

14. A sewing machine for sewing a first predetermined stitch pattern on a first workpiece and a second predetermined stitch pattern on a second workpiece, said sewing machine comprising:

a master controller for controlling the operation of the sewing machine;

a first clamp for clamping an inner portion of the first workpiece against a sewing surface of the sewing machine;

a second clamp for clamping an inner portion of the second workpiece against the sewing surface of the sewing machine;

said first and second clamps being capable of clamping the inner portions of said first and second workpieces, respectively, so that a 360° stitch pattern may be sewn around said inner portions;

drive means coupled to said master controller for driving the first and second clamps towards and away from the sewing surface;

mounting means for slidably mounting the first and second clamps to said drive means; and a peripheral clamp coupled to said drive means for simultaneously clamping a periphery of each of said first and second workpieces;

said first and second clamps being inner clamps and having shapes which generally correspond to the shape of an inner portion of said first and second workpieces, respectively;

said first and second clamps and said peripheral clamp cooperating to clamp said inner portion and said periphery of said first and second workpieces.

15. The sewing machine as recited in claim 14 wherein the peripheral clamp comprises a first interior edge and a second interior edge which define a first and second aperture, respectively, said first clamp comprising a first exterior edge and said second clamp comprising a second exterior edge, said first and second clamps being receivable in said first and second apertures, respectively, so that said first exterior edge and said first interior edge define a first sewing area and said second exterior edge and said second interior edge define a second sewing area.

16. A sewing machine for sewing a first predetermined stitch pattern on a first workpiece and a second predetermined stitch pattern on a a second workpiece, said sewing machine comprising:

a master controller for controlling the operation of the sewing machine;

a first clamp for clamping an inner portion of the first workpiece against a sewing surface of the sewing machine;

a second clamp for clamping an inner portion of the second workpiece against the sewing surface of the sewing machine;

said first and second clamps being capable of clamping the inner portions of said first and second workpieces, respectively, so that a 360° stitch pattern may be sewn around said inner portions;

drive means coupled to said master controller for driving the first and second clamps towards and away from the sewing surface; and mounting means for slidably mounting the first and second clamps to said drive means;

a bracket coupled to said drive means; and a first quick release mechanism and a second quick release mechanism for coupling the first and second clamps, respectively, to said bracket.

17. The sewing machine as recited in claim 16 wherein said drive means comprises:

at least one solenoid coupled to said master controller, said solenoid having an armature coupled to said bracket, said master controller being capable of energizing said at least one solenoid to drive the bracket towards and away from said sewing surface thereby driving said first and second clamps towards and away from said sewing surface.

18. The sewing machine as recited in claim 16 wherein said first and second quick release mechanisms each comprise a 360° coupling for permitting the sewing machine to sew an endless stitch pattern on said first and second workpieces.

19. A sewing machine for sewing a first predetermined stitch pattern on a first workpiece and a second predetermined stitch pattern on a second workpiece, said sewing machine comprising:

a master controller for controlling the operation of the sewing machine;

a first clamp for clamping an inner portion of the first workpiece against a sewing surface of the sewing machine;

a second clamp for clamping an inner portion of the the second workpiece against the sewing surface of the sewing machine;

said first and second clamps being capable of clamping the inner portions of said first and second workpieces, respectively, so that a 360° stitch pattern may be sewn around said inner portions; and drive means coupled to said master controller for driving the first and second clamps towards and away from the sewing surface; and mounting means for slidably mounting the first and second clamps to said drive means;

said first and second workpieces each having a peripheral clamping area; and a peripheral clamp coupled to said drive means clamping at least a portion of a peripheral clamping area of either said first workpiece or said second workpiece;

said first and second clamps each having a first outer edge and a second outer edge, respectively; said peripheral clamp comprising a first inner edge defining a first aperture and a second inner edge defining a second aperture; said first and second clamps being received in said first and second apertures, respectively, said first inner edge and said first outer edge cooperating to define a first sewing area, said second inner edge and said second outer edge cooperating to define a second sewing area.

20. A sewing machine for sewing a first predetermined stitch pattern on a first workpiece and a second predetermined stitch pattern on a second workpiece, said sewing machine comprising:

a master controller for controlling the operation of the sewing machine;

a first clamp for clamping the first workpiece against a sewing surface of the sewing machine;

a second clamp for clamping a second workpiece against the sewing surface of the sewing machine; and drive means coupled to said master controller for driving the first and second clamps towards and away from the sewing surface; and mounting means for slidably mounting the first and second clamps to said drive means;

a bracket coupled to said drive means;

a first quick release mechanism and a second quick release mechanism for coupling the first and second clamps, respectively, to said bracket;

said first and second quick release mechanisms each comprising a 360° coupling for permitting the sewing machine to sew around said first and second clamps;

said bracket comprising means for permitting the first and second clamps to be moved towards and away from each other.

21. The sewing machine as recited in claim 20 wherein said bracket comprises a plurality of slots; said means comprising a plurality of fasteners operatively associated with said plurality of slots for permitting the quick release mechanisms to be adjustably fastened to said bracket to permit the quick release mechanisms and said first and second clamps to be moved towards and away from each other.

22. A sewing machine having a sewing surface, said sewing machine comprising:

a master controller for controlling the operation of the sewing machine;

a drive assembly coupled to said master controller for moving a plurality of workpieces about the sewing surface of the sewing machine;

a first clamp;

a second clamp;

said drive assembly having an arch assembly having at least one sliding bracket slidably mounted therein, said arch assembly having a first solenoid secured thereto and coupled to said master controller, said first solenoid having an armature which is coupled to said at least one sliding bracket, respectively; and coupling means for coupling said first and second clamps to said at least one sliding bracket;

said master controller being capable of energizing said first solenoid to cause said coupling means and said first and second clamps to clamp a first workpiece and a second workpiece, respectively, against the sewing surface, said master controller also being capable energizing said drive assembly to move said first and second workpieces in accordance with a computer program stored therein so that a predetermined stitch pattern can be sewn on the first and second workpieces;

said coupling means comprising an L-shaped bracket having a first leg portion coupled to said at least one sliding bracket and a second leg portion joining said first leg portion and lying in a plane which is generally coplanar with said sewing surface; said first and second clamps being releasably coupled to said second leg portion so that said first and second clamps can be quickly changed without the use of tools.

23. The sewing machine as recited in claim 22 wherein said coupling means further comprises a pair of 360° couplings coupling said first and second clamps to said L-shaped bracket to enable the sewing machine to sew around said first and second clamps.

* * * * *